US010830100B2

(12) United States Patent
Czarnecki et al.

(10) Patent No.: US 10,830,100 B2
(45) Date of Patent: Nov. 10, 2020

(54) TURBINE NOZZLE HAVING AN ANGLED INNER BAND FLANGE

(71) Applicant: GENERAL ELECTRIC COMPANY POLSKA sp. z o. o, Mazowieckie (PL)

(72) Inventors: Michal Czarnecki, Mazowieckie (PL); Michal Kowalczyk, Mazowieckie (PL); Adam Krysztopa, Mazowieckie (PL); Piotr Pachota, Mazowieckie (PL)

(73) Assignee: General Electric Company Polska Sp. Z o.o., Warsaw (PL)

( * ) Notice: Subject to any disclaimer, the term of this patent is extended or adjusted under 35 U.S.C. 154(b) by 59 days.

(21) Appl. No.: 16/057,908

(22) Filed: Aug. 8, 2018

(65) Prior Publication Data

US 2019/0085726 A1 Mar. 21, 2019

(30) Foreign Application Priority Data

Sep. 15, 2017 (EP) ..... 17461604

(51) Int. Cl.
*F01D 11/00* (2006.01)
*F01D 25/24* (2006.01)
*F01D 9/04* (2006.01)

(52) U.S. Cl.
CPC ..... *F01D 25/243* (2013.01); *F01D 9/041* (2013.01); *F01D 11/001* (2013.01); *F01D 11/005* (2013.01); *F01D 11/006* (2013.01); *F05D 2220/323* (2013.01); *F05D 2230/60* (2013.01); *F05D 2240/128* (2013.01);
(Continued)

(58) Field of Classification Search
CPC ..... F01D 25/243; F01D 11/02
See application file for complete search history.

(56) References Cited

U.S. PATENT DOCUMENTS 4,353,679 A 10/1982 Hauser
4,883,405 A * 11/1989 Walker ..... F01D 9/023 415/137

(Continued)

FOREIGN PATENT DOCUMENTS

EP 2031189 A1 3/2009
EP 2075437 A2 7/2009

(Continued)

OTHER PUBLICATIONS

Japanese Patent Office, Office Action re Japanese Patent Application No. 2018-167441, dated Nov. 12, 2019, 6 pages, Japan.

(Continued)

*Primary Examiner* — Eldon T Brockman
*Assistant Examiner* — Wesley Le Fisher
(74) *Attorney, Agent, or Firm* — McGarry Bair PC

(57) ABSTRACT

A turbine nozzle for a rotary machine including a centerline axis includes an airfoil including a leading edge and a trailing edge. The airfoil defines a throat location proximate the trailing edge. The turbine nozzle also includes an inner band assembly including a platform portion coupled to the airfoil, and a first flange coupled to the platform portion. The first flange is obliquely oriented with respect to the platform portion, and the platform portion and the first flange intersect at a point axially aligned with the throat location.

20 Claims, 6 Drawing Sheets

(52) U.S. Cl.
CPC ..... *F05D 2240/55* (2013.01); *F05D 2240/80* (2013.01); *F05D 2250/232* (2013.01); *F05D 2250/314* (2013.01)

(56) References Cited

U.S. PATENT DOCUMENTS

| | | | | |
|---|---|---|---|---|
| 5,154,577 | A * | 10/1992 | Kellock | F01D 11/005 277/641 |
| 5,211,536 | A | 5/1993 | Ackerman et al. | |
| 5,224,822 | A | 7/1993 | Lenahan et al. | |
| 5,372,476 | A | 12/1994 | Hemmelgarn et al. | |
| 5,407,319 | A * | 4/1995 | Harrogate | F01D 9/023 415/115 |
| 7,094,026 | B2 * | 8/2006 | Coign | F01D 9/023 415/189 |
| 7,121,793 | B2 | 10/2006 | Correia et al. | |
| 7,186,078 | B2 | 3/2007 | Tanaka | |
| 7,238,008 | B2 | 7/2007 | Bobo et al. | |
| 7,264,442 | B2 | 9/2007 | Harding | |
| 7,338,253 | B2 | 3/2008 | Nigmatulin et al. | |
| 7,407,368 | B2 | 8/2008 | Tanaka | |
| 8,858,169 | B2 | 10/2014 | Dakowski et al. | |
| 9,845,691 | B2 | 12/2017 | Allen et al. | |
| 10,167,728 | B2 | 1/2019 | Waki et al. | |
| 10,358,927 | B2 * | 7/2019 | Okajima | F01D 5/186 |
| 2012/0269622 | A1 * | 10/2012 | Takaoka | F01D 9/04 415/208.1 |
| 2013/0115065 | A1 * | 5/2013 | Correia | F01D 11/005 415/182.1 |
| 2013/0323042 | A1 * | 12/2013 | Feigleson | F01D 9/042 415/208.1 |
| 2014/0227088 | A1 * | 8/2014 | Beaujard | F01D 5/282 415/173.4 |
| 2015/0030442 | A1 * | 1/2015 | Waki | F01D 11/005 415/209.3 |
| 2015/0354381 | A1 | 12/2015 | Congratel et al. | |
| 2016/0017745 | A1 * | 1/2016 | Champion | F01D 5/02 415/160 |
| 2018/0202301 | A1 * | 7/2018 | Otomo | F01D 11/00 |

FOREIGN PATENT DOCUMENTS

| | | | |
|---|---|---|---|
| EP | 2832975 | A1 | 2/2015 |
| JP | 2015514921 | A | 5/2015 |
| WO | 2013146637 | A1 | 10/2013 |

OTHER PUBLICATIONS

European Search Report and Written Opinion dated Feb. 19, 2018 which was issued in connection with patent No. EP 17461604.5 which was filed on Sep. 15, 2017.

* cited by examiner

TURBINE NOZZLE HAVING AN ANGLED INNER BAND FLANGE

BACKGROUND OF THE INVENTION

The field of the disclosure relates generally to rotary machines, and more particularly, to an inner band of a turbine nozzle that includes an obliquely oriented portion.

At least some known rotary machines include a compressor, a combustor coupled downstream from the compressor, a turbine coupled downstream from the combustor, and a rotor shaft rotatably coupled between the compressor and the turbine. Some known turbines include at least one rotor disk coupled to the rotor shaft, and a plurality of circumferentially-spaced turbine blades that extend outward from each rotor disk to define half of a stage of the turbine. The other half of the turbine stage includes a row of stationary, circumferentially-spaced turbine nozzles axially positioned between adjacent rows of turbine blades. Each turbine nozzle includes an airfoil that extends radially outward from an inner band towards a turbine casing.

At least some known turbine nozzles include an inner band that includes an axially-extending platform portion and a radially-extending flange portion. The airfoil is coupled to the platform portion and the flange portion couples the turbine nozzles to retaining rings within the turbine. In at least some known turbine engines, the position of the flange portion is determined by the configuration of the retaining ring and how the retaining ring attaches to the turbine nozzle. As such, in at least some known turbine engines, the flange portion of the inner band is not axially aligned with the throat location of the turbine nozzle due to space limitations within the turbine.

Furthermore, in some known configurations, the flange portion is radially oriented and both the platform portion and the flange portion include slots defined therein that receive a strip seal. Such designs may not satisfy positive back flow margin design specifications due to increased leakage areas at the intersection of the strip seals in the platform portion and flange portion.

BRIEF DESCRIPTION

In one aspect, an inner band assembly for a turbine nozzle of a rotary machine that includes a centerline axis is provided. The inner band assembly includes a platform portion and a first flange coupled to the platform portion. The first flange is obliquely oriented with respect to the centerline axis. The inner band assembly also includes a second flange coupled to the first flange. The second flange is obliquely oriented with respect to the first flange.

In one aspect of the disclosure, which may include at least a portion of the subject matter of any of the preceding and/or following examples and aspects, the platform portion and the first flange intersect at a point that is axially aligned with a throat location that is at least partially defined by the turbine nozzle.

In one aspect of the disclosure, which may include at least a portion of the subject matter of any of the preceding and/or following examples and aspects, the platform portion extends in a substantially axial direction, and wherein the second flange extends in a substantially radial direction.

In one aspect of the disclosure, which may include at least a portion of the subject matter of any of the preceding and/or following examples and aspects, the first flange is obliquely oriented with respect to the platform portion.

In one aspect of the disclosure, which may include at least a portion of the subject matter of any of the preceding and/or following examples and aspects, the first flange includes a first end coupled to the platform portion, a second end coupled to the second flange, and a forward surface extending between the first end and the second end. The first flange also includes an aft surface extending between the first end and the second end, wherein the forward surface and the aft surface define a thickness therebetween that is constant between the first end and the second end.

In one aspect of the disclosure, which may include at least a portion of the subject matter of any of the preceding and/or following examples and aspects, the platform portion includes a platform seal slot including a first end and a second end. The first flange includes flange seal slot that intersects the platform seal slot, wherein the flange seal slot is obliquely oriented with respect to the platform seal slot.

In one aspect of the disclosure, which may include at least a portion of the subject matter of any of the preceding and/or following examples and aspects, the flange seal slot intersects the platform seal slot at a throat location at least partially defined by the turbine nozzle.

In one aspect of the disclosure, which may include at least a portion of the subject matter of any of the preceding and/or following examples and aspects, the flange seal slot extends into the second flange.

In one aspect of the disclosure, which may include at least a portion of the subject matter of any of the preceding and/or following examples and aspects, the second flange includes a forward surface, and wherein the flange seal slot is at least partially defined in the forward surface.

In one aspect of the disclosure, which may include at least a portion of the subject matter of any of the preceding and/or following examples and aspects, the second flange is oriented perpendicular to the centerline axis.

In another aspect, a turbine nozzle for a rotary machine including a centerline axis is provided. The turbine nozzle includes an airfoil including a leading edge and a trailing edge. The airfoil defines a throat location proximate the trailing edge. The turbine nozzle also includes an inner band assembly including a platform portion coupled to the airfoil, and a first flange coupled to the platform portion. The first flange is obliquely oriented with respect to the platform portion, and the platform portion and the first flange intersect at a point axially aligned with the throat location.

In one aspect of the disclosure, which may include at least a portion of the subject matter of any of the preceding and/or following examples and aspects, the first flange is obliquely oriented with respect to the centerline axis.

In one aspect of the disclosure, which may include at least a portion of the subject matter of any of the preceding and/or following examples and aspects, a second flange is coupled to the first flange, wherein the second flange is obliquely oriented with respect to the first flange.

In one aspect of the disclosure, which may include at least a portion of the subject matter of any of the preceding and/or following examples and aspects, the platform portion extends in a substantially axial direction, and wherein the second flange extends in a substantially radial direction.

In one aspect of the disclosure, which may include at least a portion of the subject matter of any of the preceding and/or following examples and aspects, the first flange is positioned radially inward of the platform portion and wherein the second flange is positioned radially inward of the first flange.

In one aspect of the disclosure, which may include at least a portion of the subject matter of any of the preceding and/or following examples and aspects, the second flange is axially offset from the throat location.

In another aspect, a method of manufacturing a turbine nozzle for a rotary machine including a centerline axis is provided. The method includes coupling an airfoil to a platform portion of an inner band assembly and coupling a first flange of the inner band assembly to the platform portion such that the first flange is obliquely oriented with respect to the centerline axis. The method also includes coupling a second flange of the inner band assembly to the first flange such that the second flange is obliquely oriented with respect to the first flange.

In one aspect of the disclosure, which may include at least a portion of the subject matter of any of the preceding and/or following examples and aspects, coupling the first flange to the platform portion includes coupling the first flange to the platform portion such that the first flange and the platform portion intersect at a throat location at least partially defined by the airfoil.

In one aspect of the disclosure, which may include at least a portion of the subject matter of any of the preceding and/or following examples and aspects, coupling the airfoil to the platform portion includes coupling the airfoil to the platform portion such that the platform portion extends in a substantially axial direction. Furthermore, coupling the second flange to the first flange includes coupling the second flange to the first flange such that the second flange extends in a substantially radial direction.

In one aspect of the disclosure, which may include at least a portion of the subject matter of any of the preceding and/or following examples and aspects, coupling the first flange to the platform portion includes coupling the first flange to the platform portion such that the first flange is obliquely oriented with respect to the platform portion.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Figure 1:
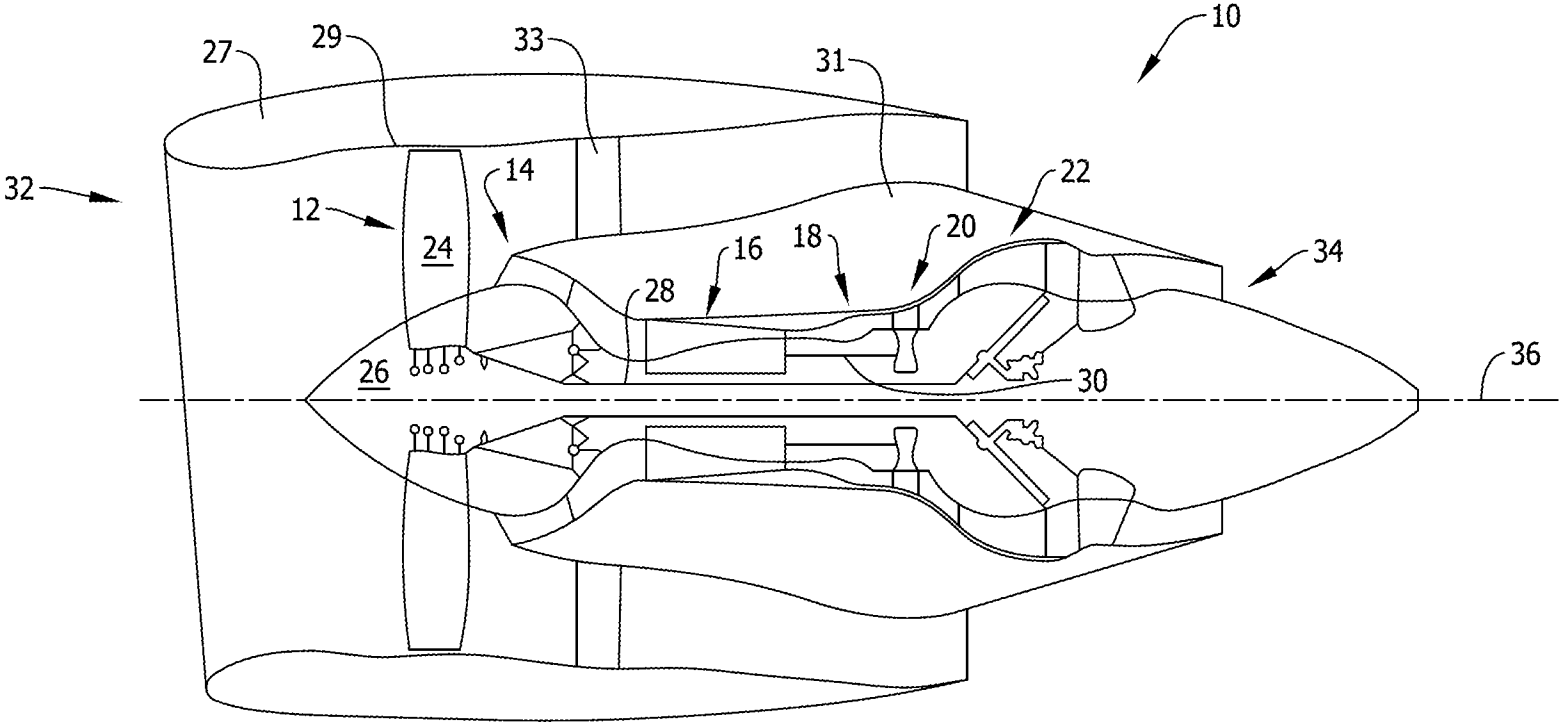
FIG. 1 is a schematic view of an exemplary rotary machine.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION OF THE INVENTION

Embodiments of the present disclosure relate to a turbine nozzle for a rotary machine having an angled flange at least partially aligned with a throat of the turbine nozzle. More specifically, the turbine nozzle includes an airfoil that defines a throat location proximate a trailing edge. The turbine nozzle also includes an inner band assembly including a platform portion coupled to the airfoil, and a first flange coupled to the platform portion. The first flange is obliquely oriented with respect to the platform portion, and the platform portion and the first flange intersect at a point axially aligned with the throat location. The inner band assembly also includes a second flange coupled to the first flange such that the second flange is obliquely oriented with respect to the first flange. The design features include positioning an intersection of the platform portion and the first flange at the throat location while also offsetting the second flange from the throat location. Such a configuration may be used in smaller sized rotary machines where spaced for the inner band assembly is limited. Furthermore, the slanted first flange creates a pressurization area inward of the platform portion that maintains a positive backflow margin up to the throat location. More specifically, axial alignment of a high static pressure area and the pressurization area forward of the first flange reduces or prevents purge air from leaking across platform portions of adjacent turbine nozzles and intermixing with the hot combustion gases in the combustion gas path.

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. In addition, as used herein, the terms "circumferential" and "circumferentially" refer to directions and orientations that extend arcuately about the centerline of the turbine engine. As used herein, the terms "oblique" and "obliquely" refer to orientations that extend in both non-parallel and non-perpendicular directions from a respective component or surface. More specifically, "oblique" and "obliquely" refer to an angle of orientation between two components or surfaces that is not 0 degrees, 90 degrees, or 180 degrees.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item. As used herein, the term "upstream" refers to a forward or inlet end of a gas turbine engine, and the term "downstream" refers to an aft or nozzle end of the gas turbine engine.

FIG. 1 is a schematic view of an exemplary rotary machine 10, i.e., a turbomachine, and more specifically a turbine engine. In the exemplary embodiment, rotary machine 10 is a gas turbine engine. Alternatively, rotary machine 10 may be any other turbine engine and/or rotary machine, including, without limitation, a steam turbine engine, a gas turbofan aircraft engine, or another aircraft engine. In the exemplary embodiment, rotary machine 10 includes a fan assembly 12, a low-pressure or booster compressor assembly 14, a high-pressure compressor assembly 16, and a combustor assembly 18. Fan assembly 12, booster compressor assembly 14, high-pressure compressor assembly 16, and combustor assembly 18 are coupled in flow communication. Rotary machine 10 also includes a high-pressure turbine assembly 20 coupled in flow communication with combustor assembly 18 and a low-pressure turbine assembly 22. Fan assembly 12 includes an array of fan blades 24 extending radially outward from a rotor disk 26 toward a nacelle 27 that includes a fan case 29. A turbine case 31 extends circumferentially around low-pressure or booster compressor assembly 14, high-pressure compressor assembly 16, combustor assembly 18, high-pressure turbine assembly 20, and low-pressure turbine assembly 22. Rotary machine 10 also includes an outlet guide vane 33 positioned aft of fan assembly 12 and extending from turbine case 31 to fan case 29. Low-pressure turbine assembly 22 is coupled to fan assembly 12 and booster compressor assembly 14 through a first drive shaft 28, and high-pressure turbine assembly 20 is coupled to high-pressure compressor assembly 16 through a second drive shaft 30. Rotary machine 10 includes an intake 32, an exhaust 34, and a centerline axis 36 about which fan assembly 12, booster compressor assembly 14, high-pressure compressor assembly 16, and turbine assemblies 20 and 22 rotate.

In operation, air entering rotary machine 10 through intake 32 is channeled through fan assembly 12 towards booster compressor assembly 14. Compressed air is discharged from booster compressor assembly 14 towards high-pressure compressor assembly 16. Highly compressed air is channeled from high-pressure compressor assembly 16 towards combustor assembly 18, mixed with fuel, and the mixture is combusted within combustor assembly 18. High temperature combustion gas generated by combustor assembly 18 is channeled towards turbine assemblies 20 and 22. Combustion gas is subsequently discharged from rotary machine 10 via exhaust 34.

Figure 2:
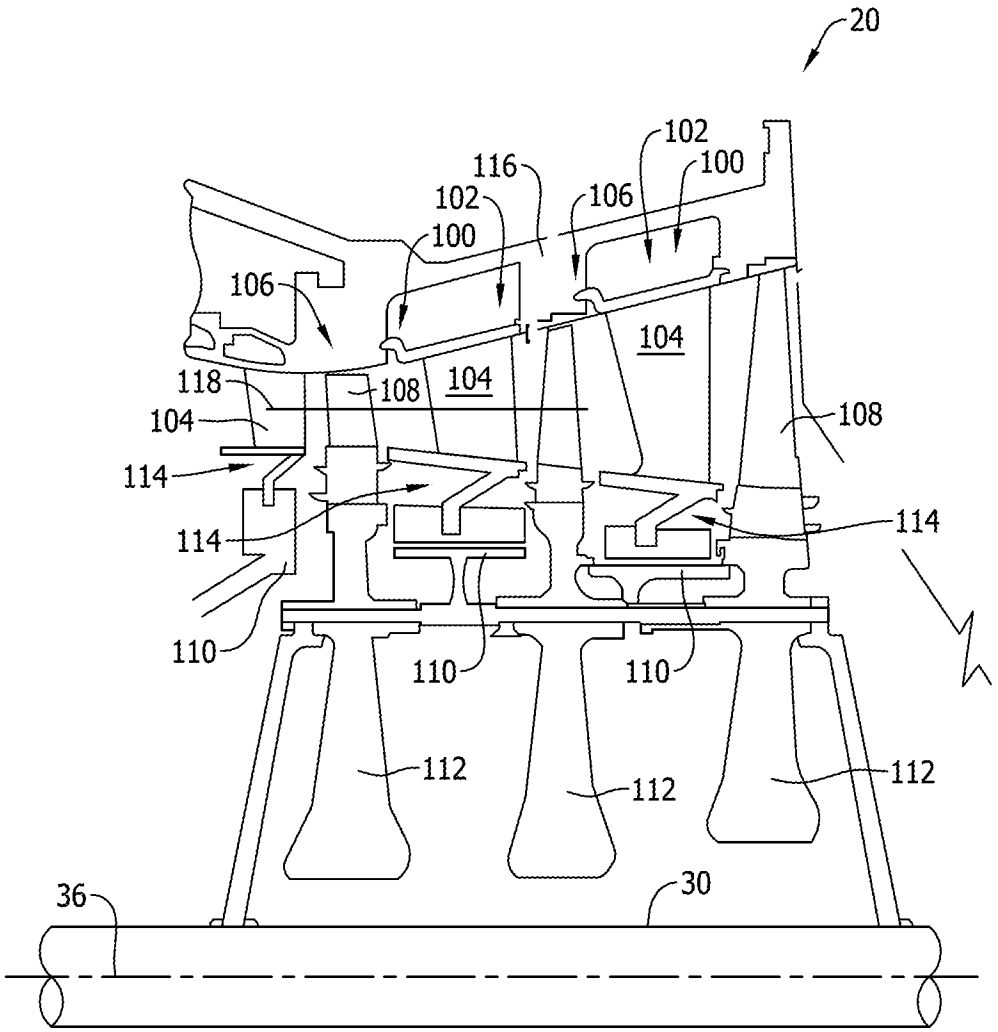
FIG. 2 is a partial sectional view of a portion of an exemplary high-pressure turbine assembly that may be used with the rotary machine shown in FIG. 1.

FIG. 2 is a partial sectional view of a portion of high-pressure turbine assembly 20. In the exemplary embodiment, high-pressure turbine assembly 20 includes a plurality of stages 100 that each include a stationary row 102 of a plurality of circumferentially-spaced stator vanes or turbine nozzles 104 and a corresponding row 106 of a plurality of circumferentially-spaced rotating turbine blades 108. Turbine nozzles 104 in each row 102 are spaced-circumferentially about, and each extends radially outward from, a retaining ring 110 that is coupled between a corresponding turbine nozzle 104 and a stationary component of high-pressure turbine assembly 20. More specifically, each turbine nozzle 104 includes an inner band 114 that is coupled to a respective retaining ring 110. Each turbine blade 108 is coupled to a radially inner rotor disk 112, which is coupled to second drive shaft 30 and rotates about centerline axis 36 that is defined by second drive shaft 30. A turbine casing 116 extends circumferentially about turbine nozzles 104 and turbine blades 108. Turbine nozzles 104 are each coupled to turbine casing 116 and each extends radially inward from turbine casing 116 towards second drive shaft 30. A combustion gas path 118 is defined between turbine casing 116 and each rotor disk 112. Each row 106 and 102 of turbine blades 108 and turbine nozzles 104 extends at least partially through a portion of combustion gas path 118. In operation, the combustion gases are channeled along combustion gas path 118 and impinge upon turbine blades 108 and turbine nozzles 104 to facilitate imparting a rotational force on high-pressure turbine assembly 20.

Figure 3:
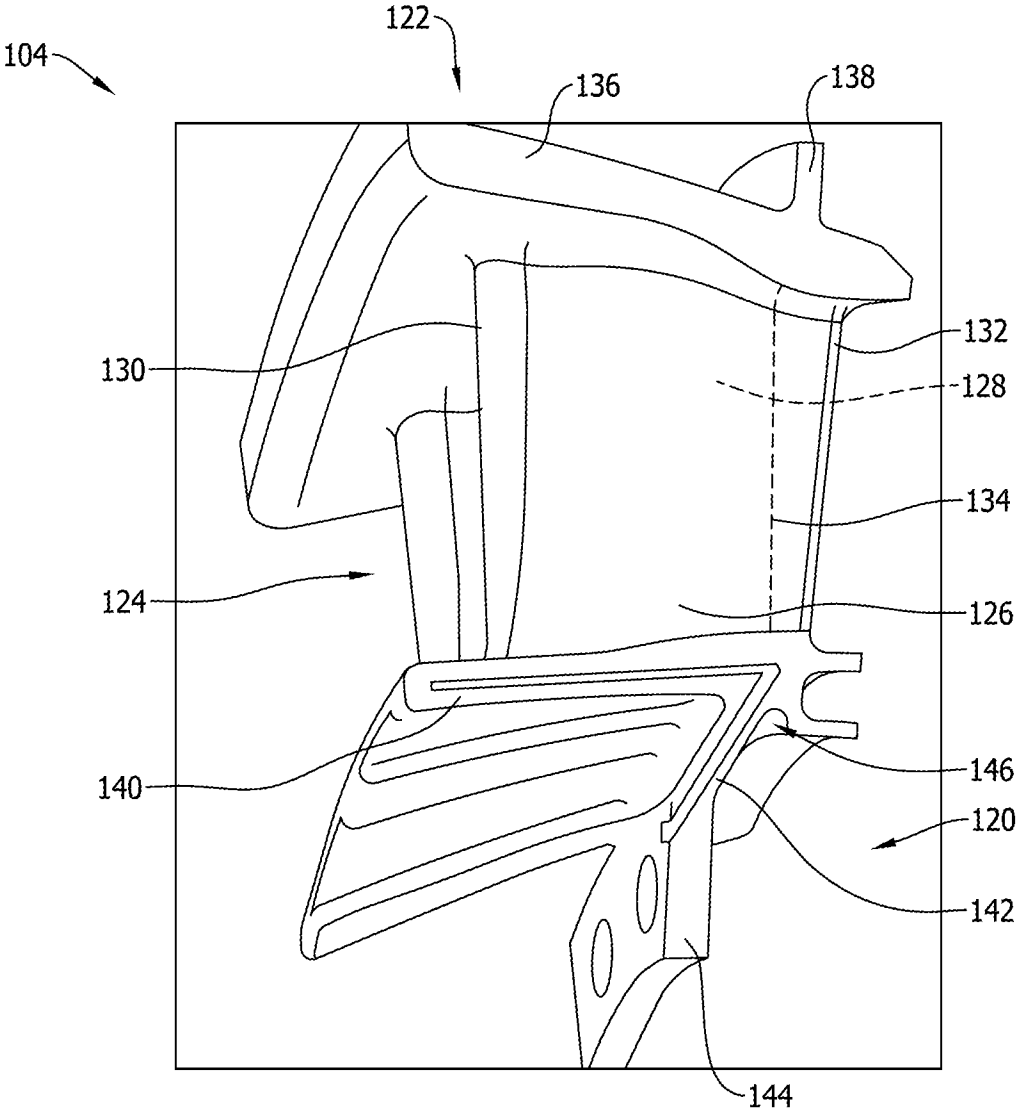
FIG. 3 is a perspective view of an exemplary turbine nozzle that may be used with the high-pressure turbine assembly shown in FIG. 2.
Figure 4:
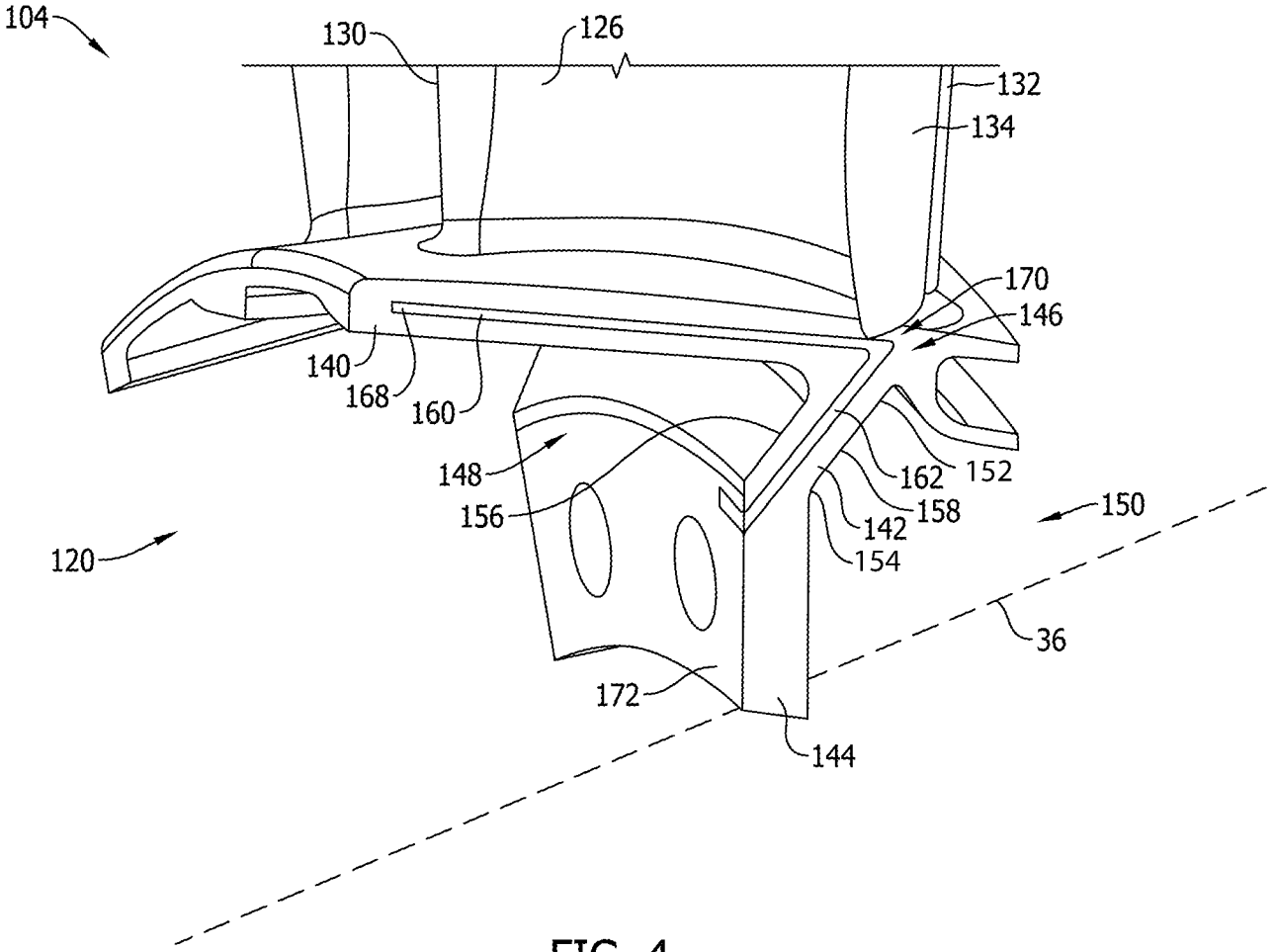
FIG. 4 is a perspective view of an exemplary inner band that may be used with the turbine nozzle shown in FIG. 3.
Figure 5:
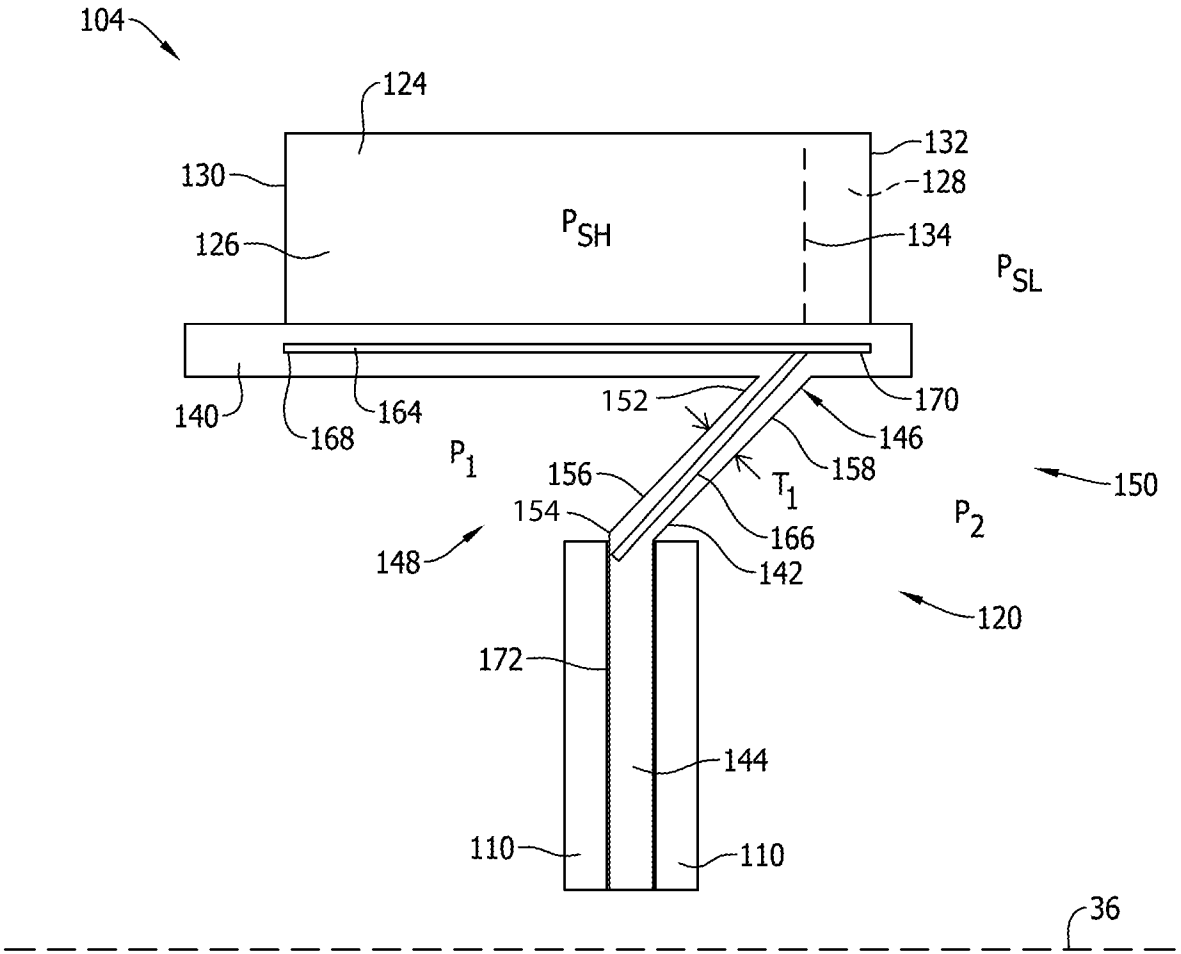
FIG. 5 is a schematic view of the turbine nozzle that may be used with the high-pressure turbine assembly shown in FIG. 2.

FIG. 3 is a perspective view of turbine nozzle 104 that may be used with high-pressure turbine assembly 20 (shown in FIG. 2), and FIG. 4 is a perspective view of inner band 114 including an exemplary inner band assembly 120 that may be used with turbine nozzle 104. FIG. 5 is a schematic view of turbine nozzle 104 that may be used with the high-pressure turbine assembly shown in FIG. 2. Turbine nozzle 104 is one segment of a plurality of segments that are positioned circumferentially about the centerline axis 36 of rotary machine 10 to form row 102 of turbine nozzle 104 within high-pressure turbine assembly 20. In the exemplary embodiment, turbine nozzle 104 includes an inner band assembly 120, an outer band assembly 122, and at least one airfoil 124 coupled to and extending between inner band assembly 120 and outer band assembly 122. More specifically, in one embodiment, inner band assembly 120 and outer band assembly 122 are each integrally-formed with airfoil 124.

Airfoil 124 includes a pressure-side sidewall 126 and a suction-side sidewall 128 that are connected at a leading edge 130 and at a chordwise-spaced trailing edge 132 such that sidewalls 126 and 128 are defined between edges 130 and 132. Sidewalls 126 and 128 each extend radially between inner band assembly 120 and outer band assembly 122. In one embodiment, sidewall 126 is generally concave and sidewall 128 is generally convex. Airfoil 124 also at least partially defines a throat location 134 proximate trailing edge 132. As used herein, the term "throat location" identifies an axial location of the throat between circumferentially adjacent airfoils 124 in row 102 of turbine nozzles 104. Further, the term "throat" is used herein to indicate the minimum restriction distance between circumferentially adjacent airfoils 124. Specifically, the throat is the minimum distance from the pressure-side sidewall 126, and more specifically, from the trailing edge 132 of the pressure-side sidewall 126 on one airfoil 124 to the suction-side sidewall 128 of the adjacent airfoil 124. Throat location 134 occurs where combustion gases 118 (shown in FIG. 2) have the highest velocity and also represents the location where an area of high static pressure is separated from an area of low static pressure, as described herein.

In the exemplary embodiment, outer band assembly 122 includes a platform portion 136 coupled to airfoil 124 and a flange portion 138 extending radially outward from platform portion 136. At least one of platform portion 136 and flange portion 138 is coupled to turbine casing 116. Similarly, inner band assembly 120 includes a platform portion 140, a first flange 142, and a second flange 144. As shown in FIGS. 3-5, platform portion 140 is coupled to airfoil 124 and extends in a substantially axial direction. Furthermore, first flange 142 is coupled to platform portion 140 and is obliquely oriented with respect to centerline axis 36. As such, first flange 142 is also obliquely oriented with respect to platform portion 140. Additionally, second flange 144 is coupled to first flange 142 such that second flange 144 is obliquely oriented with respect to first flange 142 and also extends from first flange 142 in a substantially radial direction. Specifically, first flange 142 extends from and is positioned radially inward of platform portion 140, and second flange 144 extends from and is positioned radially inward of first flange 142.

As shown in FIGS. 3-5, throat location 134 is positioned proximate trailing edge 132 of airfoil 124. Furthermore, in the exemplary embodiment, platform portion 140 and first flange 142 intersect at a point 146 that is axially aligned with throat location 134. First flange 142 then extends obliquely in both a radial and forward direction to couple with second flange 144. In such a configuration, second flange 144 is axially offset from throat location 134. More specifically, second flange 144 forms a bolted joint with retaining ring 110 at a location that is axially offset from throat location 134. As shown in FIG. 5, throat location 134 separates a high static pressure area $P_{SH}$, forward of throat location 134, from a low static pressure area $P_{SL}$, aft of throat location 134. Furthermore, first flange 142 separates a nozzle cavity 148, forward of first flange 142 and having a first pressure $P_1$, from a blade cavity 150, aft of first flange 142 and having a second pressure $P_2$ that is lower than first pressure $P_1$ of nozzle cavity 148. Additionally, second pressure $P_2$ is substantially similar to low static pressure area $P_{SL}$. In the exemplary embodiment, obliquely oriented first flange 142 extends nozzle cavity 148 such that nozzle cavity 148 terminates at a location substantially axially aligned with throat location 134 and with intersection point 146. Such axial alignment of high static pressure area $P_{SH}$ and nozzle cavity 148 at first pressure $P_1$ reduces or prevents purge air from leaking from nozzle cavity 148 across platform portions 140 of adjacent turbine nozzles 104.

In the exemplary embodiment, first flange 142 includes a first end 152 coupled to platform portion 140 and a second end 154 coupled to second flange 144. First flange 142 also includes a forward surface 156 extending between first end 152 and second end 154 and an aft surface 158 extending between first end 152 and second end 154. As best shown in FIG. 5, forward surface 156 and aft surface 158 are parallel to each other and define a thickness $T_1$ therebetween that is constant between first end 152 and second end 154.

In the exemplary embodiment, as best shown in FIG. 4, platform portion 140 includes a platform seal slot 160 defined therein and first flange 142 includes a flange seal slot 162 defined therein. Platform seal slot 160 is configured to receive a platform seal member 164, and flange seal slot 162 is configured to receive a flange seal member 166. Seal members 164 and 166 reduce or prevent purge air in nozzle cavity 148 from leaking between adjacent turbine nozzles 104 and intermixing with the hot combustion gases in combustion gas path 118 (shown in FIG. 2).

Figure 6:
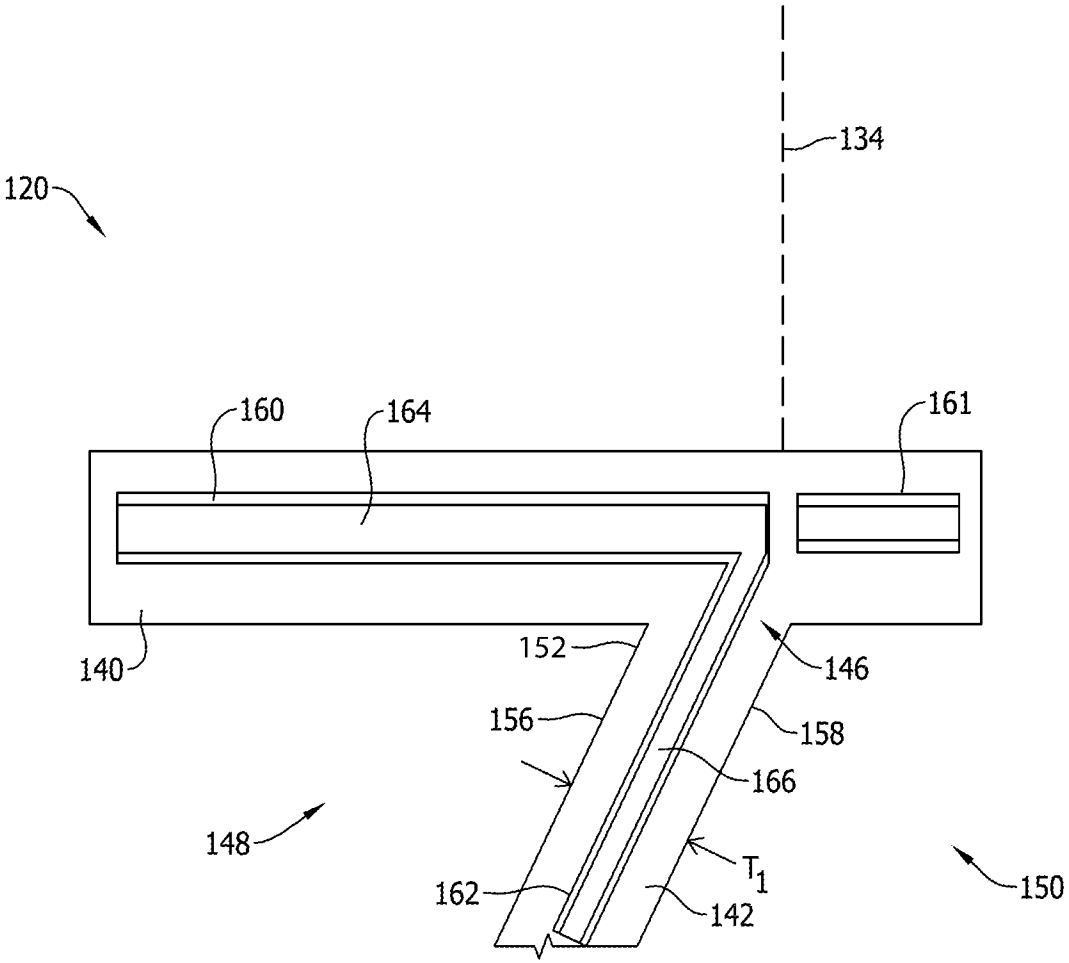
FIG. 6 is a schematic view of an alternative inner band that may be used with the turbine nozzle shown in FIG. 3.

As shown in FIG. 3-5, similar to first flange 142 and platform portion 140, flange seal slot 162 is obliquely oriented with respect to platform seal slot 160. Additionally, flange seal slot 162 intersects platform seal slot 160 at throat location 134. In such a configuration, flange seal member 166 also intersects platform seal member 164 at throat location 134. It is also contemplated that flange seal slot 162 intersects platform seal slot 160 forward of throat location 134 and a second platform seal slot 161 is formed in platform portion 140 aftward of platform seal slot 160 such that no seal slot or seal is present at throat location 134, as is shown in FIG. 6.

In the embodiment shown in FIGS. 3 and 4, platform seal slot 160 includes a first end 168 and an opposing second end 170, wherein flange seal slot 162 extends from second end 170 and second end 170 is aligned with throat location. In the embodiment shown in FIG. 5, flange seal slot 162 and flange seal member 166 intersect with platform seal slot 160 and platform seal member 164 at throat location 134, but second end 170 extends axially aftward beyond throat location 134 and flange seal slot 162 and flange seal member 166. Furthermore, as shown in FIGS. 3-5, flange seal slot 162 extends radially into second flange 144 such that flange seal slot 162 is at least partially defined in a forward surface 172 of second flange 144, as best shown in FIG. 4.

Embodiments of the present disclosure relate to a turbine nozzle for a rotary machine having an angled flange at least partially aligned with a throat of the turbine nozzle. More specifically, the turbine nozzle includes an airfoil that defines a throat location proximate a trailing edge. The turbine nozzle also includes an inner band assembly including a platform portion coupled to the airfoil, and a first flange coupled to the platform portion. The first flange is obliquely oriented with respect to the platform portion, and the platform portion and the first flange intersect at a point axially aligned with the throat location. The inner band assembly also includes a second flange coupled to the first flange such that the second flange is obliquely oriented with respect to the first flange.

The design features include positioning an intersection of the platform portion and the first flange at the throat location while also offsetting the second flange from the throat location. Such a configuration may be used in smaller sized rotary machines where spaced for the inner band assembly is limited. Furthermore, the slanted first flange creates a pressurization area inward of the platform portion that maintains a positive backflow margin up to the throat location. More specifically, axial alignment of a high static pressure area and the pressurization area forward of the first flange reduces or prevents purge air from leaking across platform portions of adjacent turbine nozzles and intermixing with the hot combustion gases in the combustion gas path.

Exemplary embodiments of a turbine nozzle having an angled flange on the inner band assembly are described above in detail. The turbine nozzle is not limited to the specific embodiments described herein, but rather, components and steps may be utilized independently and separately from other components and/or steps described herein. For example, the embodiments may also be used in combination with other systems and methods, and are not limited to practice with only the gas turbine engine assembly as described herein. Rather, the exemplary embodiment may be implemented and utilized in connection with many other turbine applications.

Although specific features of various embodiments of the device may be shown in some drawings and not in others, this is for convenience only. Moreover, references to "one embodiment" in the above description are not intended to be interpreted as excluding the existence of additional embodiments that also incorporate the recited features. In accordance with the principles of the device, any feature of a drawing may be referenced and/or claimed in combination with any feature of any other drawing.

This written description uses examples to disclose the device, including the best mode, and also to enable any person skilled in the art to practice the disclosure, including making and using any devices or systems and performing any incorporated methods. The patentable scope of the device is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An inner band assembly for a turbine nozzle of a rotary machine that includes a centerline axis, said inner band assembly comprising:

a platform portion;

a first flange coupled to said platform portion, wherein said first flange is obliquely oriented with respect to the centerline axis; and a second flange coupled to said first flange, wherein said second flange is obliquely oriented with respect to said first flange, wherein said platform portion includes a platform seal slot including a first end and a second end, and wherein said first flange includes flange seal slot that intersects said platform seal slot, wherein said flange seal slot is obliquely oriented with respect to said platform seal slot;

wherein said flange seal slot intersects said platform seal slot at a throat location at least partially defined by the turbine nozzle.

2. The inner band assembly in accordance with claim 1, wherein said platform portion and said first flange intersect at a point that is axially aligned with the throat location that is at least partially defined by the turbine nozzle.

3. The inner band assembly in accordance with claim 1, wherein said platform portion extends in a substantially axial direction, and wherein said second flange extends in a substantially radial direction.

4. The inner band assembly in accordance with claim 3, wherein said first flange is obliquely oriented with respect to said platform portion.

5. The inner band assembly in accordance with claim 1, wherein said first flange comprises:

a first end coupled to said platform portion;

a second end coupled to said second flange;

a forward surface extending between said first end and said second end; and an aft surface extending between said first end and said second end, wherein said forward surface and said aft surface define a thickness therebetween, wherein the thickness of said first flange is constant between said first end and said second end.

6. The inner band assembly in accordance with claim 1, wherein said flange seal slot extends into said second flange.

7. The inner band assembly in accordance with claim 6, wherein said second flange includes a forward surface, and wherein said flange seal slot is at least partially defined in said forward surface.

8. The inner band assembly in accordance with claim 1, wherein said second flange is oriented perpendicular to the centerline axis.

9. A turbine nozzle for a rotary machine including a centerline axis, said turbine nozzle comprising:

an airfoil comprising a leading edge and a trailing edge and an inner band assembly comprising:

a platform portion coupled to said airfoil; and a first flange coupled to said platform portion, wherein said first flange is obliquely oriented with respect to said platform portion, wherein said platform portion includes a platform seal slot including a first end and a second end, and wherein said first flange includes a flange seal slot that intersects said platform seal slot, wherein said flange seal slot is obliquely oriented with respect to said platform seal slot;

wherein said flange seal slot intersects said platform seal slot at a throat location at least partially defined by the turbine nozzle.

10. The turbine nozzle in accordance with claim 9, wherein said first flange is obliquely oriented with respect to the centerline axis.

11. The turbine nozzle in accordance with claim 9, further comprising a second flange coupled to said first flange, wherein said second flange is obliquely oriented with respect to said first flange.

12. The turbine nozzle in accordance with claim 11, wherein said platform portion extends in a substantially axial direction, and wherein said second flange extends in a substantially radial direction.

13. The turbine nozzle in accordance with claim 11, wherein said first flange is positioned radially inward of said platform portion and wherein said second flange is positioned radially inward of said first flange.

14. The turbine nozzle in accordance with claim 11, wherein said second flange is axially offset from the throat location.

15. The turbine nozzle in accordance with claim 11, wherein said flange seal slot extends into said second flange.

16. The turbine nozzle in accordance with claim 15, wherein said second flange includes a forward surface, and wherein said flange seal slot is at least partially defined in said forward surface.

17. A method of manufacturing a turbine nozzle for a rotary machine including a centerline axis, said method comprising:

coupling an airfoil to a platform portion of an inner band assembly, the platform including a platform seal slot including a first end and a second end;

coupling a first flange of the inner band assembly to the platform portion such that the first flange is obliquely oriented with respect to the centerline axis, the first flange including a flange seal slot that intersects the platform seal slot, wherein said flange seal slot is obliquely oriented with respect to said platform seal slot, and wherein said flange seal slot intersects said platform seal slot at a throat location at least partially defined by the turbine nozzle; and coupling a second flange of the inner band assembly to the first flange such that the second flange is obliquely oriented with respect to said first flange.

18. The method in accordance with claim 17, wherein coupling the first flange to the platform portion comprises coupling the first flange to the platform portion such that the first flange and the platform portion intersect at a throat location at least partially defined by the airfoil.

19. The method in accordance with claim 18, coupling the first flange to the platform portion comprises coupling the first flange to the platform portion such that the first flange is obliquely oriented with respect to the platform portion.

20. The method in accordance with claim 17, wherein coupling the airfoil to the platform portion comprises coupling the airfoil to the platform portion such that the platform portion extends in a substantially axial direction, and wherein coupling the second flange to the first flange comprises coupling the second flange to the first flange such that the second flange extends in a substantially radial direction.

* * * * *